US011586151B2

(12) United States Patent
Takasawa

(10) Patent No.: US 11,586,151 B2
(45) Date of Patent: Feb. 21, 2023

(54) METHOD FOR MANUFACTURING WATCH COMPONENT

(71) Applicant: Seiko Epson Corporation, Tokyo (JP)

(72) Inventor: Koki Takasawa, Suwa (JP)

(73) Assignee: SEIKO EPSON CORPORATION

( * ) Notice: Subject to any disclaimer, the term of this patent is extended or adjusted under 35 U.S.C. 154(b) by 174 days.

(21) Appl. No.: 17/118,797

(22) Filed: Dec. 11, 2020

(65) Prior Publication Data

US 2021/0181683 A1 Jun. 17, 2021

(30) Foreign Application Priority Data

Dec. 13, 2019 (JP) ..... JP2019-225200

(51) Int. Cl.
*G04B 29/02* (2006.01)
*C21D 6/00* (2006.01)

(52) U.S. Cl.
CPC ..... *G04B 29/027* (2013.01); *C21D 6/002* (2013.01)

(58) Field of Classification Search
None
See application file for complete search history.

(56) References Cited

U.S. PATENT DOCUMENTS

2009/0073815 A1 3/2009 Takasawa

FOREIGN PATENT DOCUMENTS

EP 2037337 A1 * 3/2009 ..... G04B 43/00
JP 2013-101157 A 5/2013

* cited by examiner

*Primary Examiner* — Anthony M Liang
(74) *Attorney, Agent, or Firm* — Harness, Dickey & Pierce, P.L.C.

(57) ABSTRACT

A method for manufacturing a watch component is a method for manufacturing a watch component formed of austenitized ferritic stainless steel including a base formed of a ferrite phase and a surfacing layer formed of an austenitized phase in which the ferrite phase is austenitized, the method including a first processing step for forming a hole portion or a recessed portion at a base material formed of ferrite stainless steel, a heat treatment step for performing a nitrogen absorption treatment on the base material to form the surfacing layer at a surface side of the base, and a second processing step for cutting a surfacing layer corresponding to the hole portion or the recessed portion to form the watch component.

10 Claims, 7 Drawing Sheets

METHOD FOR MANUFACTURING WATCH COMPONENT

The present application is based on, and claims priority from JP Application Serial Number 2019-225200, filed Dec. 13, 2019, the disclosure of which is hereby incorporated by reference herein in its entirety.

BACKGROUND

1. Technical Field

The present disclosure relates to a method for manufacturing a watch component.

2. Related Art

JP 2013-101157 A discloses a watch housing using ferritic stainless steel in which a surfacing layer is austenitized by nitrogen absorption treatment, specifically, a case band and a case back.

In JP 2013-101157 A, austenitization of the surfacing layer of ferritic stainless steel results in hardness, corrosion resistance, and antimagnetic performance required as a watch housing.

In the watch housing described in JP 2013-101157 A, when a through hole or a recessed portion is formed for disposing a button or crown, an internal ferrite phase is exposed. Accordingly, there has been a problem in that corrosion resistance may deteriorate in the through hole or the recessed portion.

SUMMARY

A method for manufacturing a watch component of the present disclosure is a method for manufacturing a watch component formed of austenitized ferritic stainless steel including a base formed of a ferrite phase and a surfacing layer formed of an austenitized phase in which the ferrite phase is austenitized, that includes a first processing step for forming a hole portion or a recessed portion at a base material formed of ferrite stainless steel, a heat treatment step for performing a nitrogen absorption treatment on the base material to form the surfacing layer at a surface side of the base, and a second processing step for cutting the surfacing layer corresponding to the hole portion or the recessed portion to form the watch component.

DESCRIPTION OF EXEMPLARY EMBODIMENTS

Exemplary Embodiment

A watch 1 of an exemplary embodiment of the present disclosure will be described below with reference to the drawings.

Figure 1:
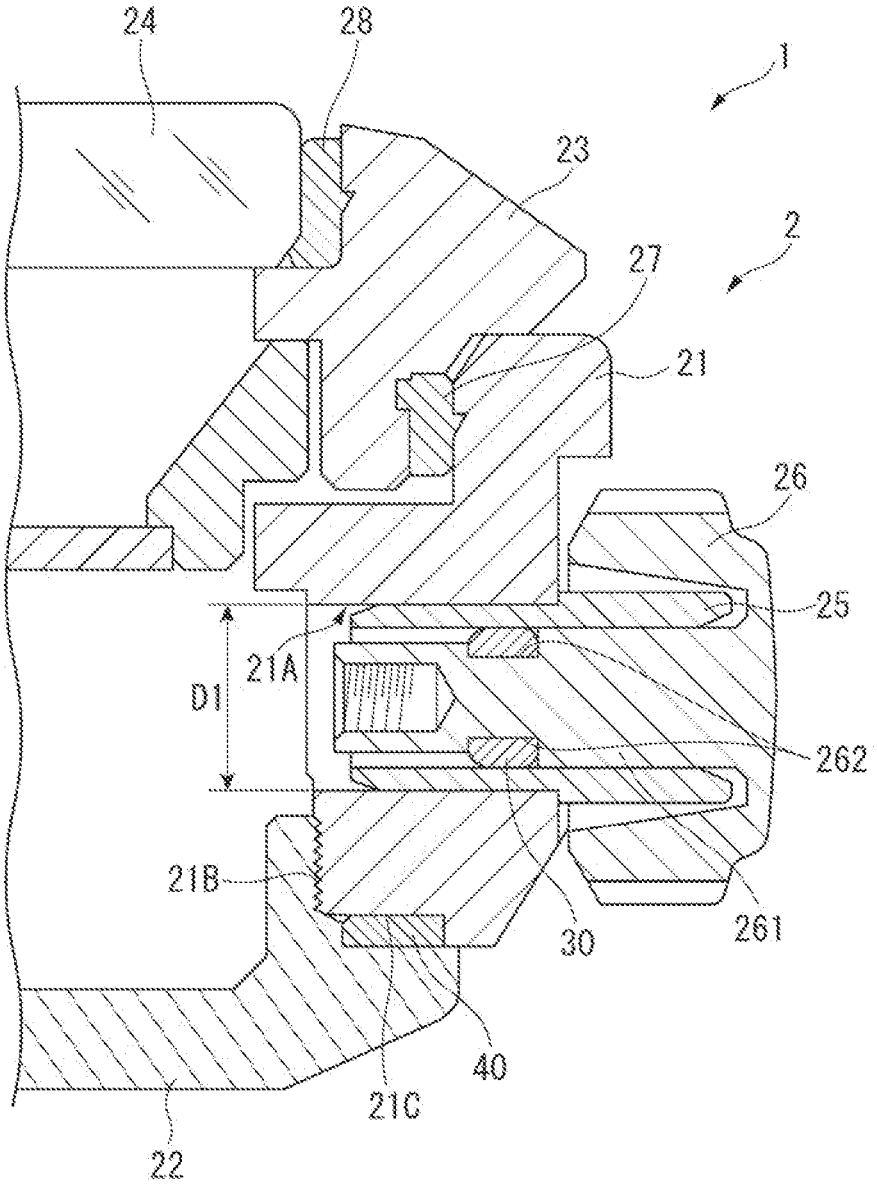
FIG. 1 is a partial cross-sectional view schematically illustrating a watch of an exemplary embodiment.

FIG. 1 is a partial cross-sectional view schematically illustrating the watch 1 of the present exemplary embodiment.

As illustrated in FIG. 1, the watch 1 includes an outer packaging case 2. The outer packaging case 2 includes a cylindrical case main body 21, a case back 22 fixed to a back surface side of the case main body 21, an annular bezel 23 fixed to a front surface side of the case main body 21, and a glass plate 24 held by the bezel 23. Furthermore, a movement (not illustrated) is housed in the case main body 21. Note that, the case main body 21 is an example of a watch component of the present disclosure.

A through hole 21A is provided in the case main body 21. A winding stem pipe 25 is fitted into and fixed to the through hole 21A. Note that, a diameter of the through hole 21A is set to D1, in accordance with an outer diameter of the winding stem pipe 25. A shaft portion 261 of a crown 26 is rotatably inserted into the winding stem pipe 25.

The case main body 21 and the bezel 23 engage with each other via a plastic packing 27, and the bezel 23 and the glass plate 24 are fixed to each other by a plastic packing 28.

Furthermore, a threaded portion 21B that is engaged with the case back 22, and a storage recessed portion 21C on which a case back packing 40 is disposed are provided on the case main body 21. Accordingly, when the case main body 21 is engaged with the case back 22, a space between the case main body 21 and the case back 22 is liquid-tightly sealed and a waterproof function is obtained.

A groove 262 is formed at an outer periphery halfway the shaft portion 261 of the crown 26, and a ring-shaped rubber packing 30 is fitted into the groove 262. The rubber packing 30 adheres to an inner circumferential surface of the winding stem pipe 25, and is compressed between the inner circumferential surface and an inner surface of the groove 262. According to this configuration, a gap between the crown 26 and the winding stem pipe 25 is liquid-tightly sealed and a waterproof function is obtained. Note that, when the crown 26 is rotated and operated, the rubber packing 30 rotates together with the shaft portion 261 and, slides in a circumferential direction while adhering to the inner circumferential surface of the winding stem pipe 25.

Case Main Body

Figure 2:
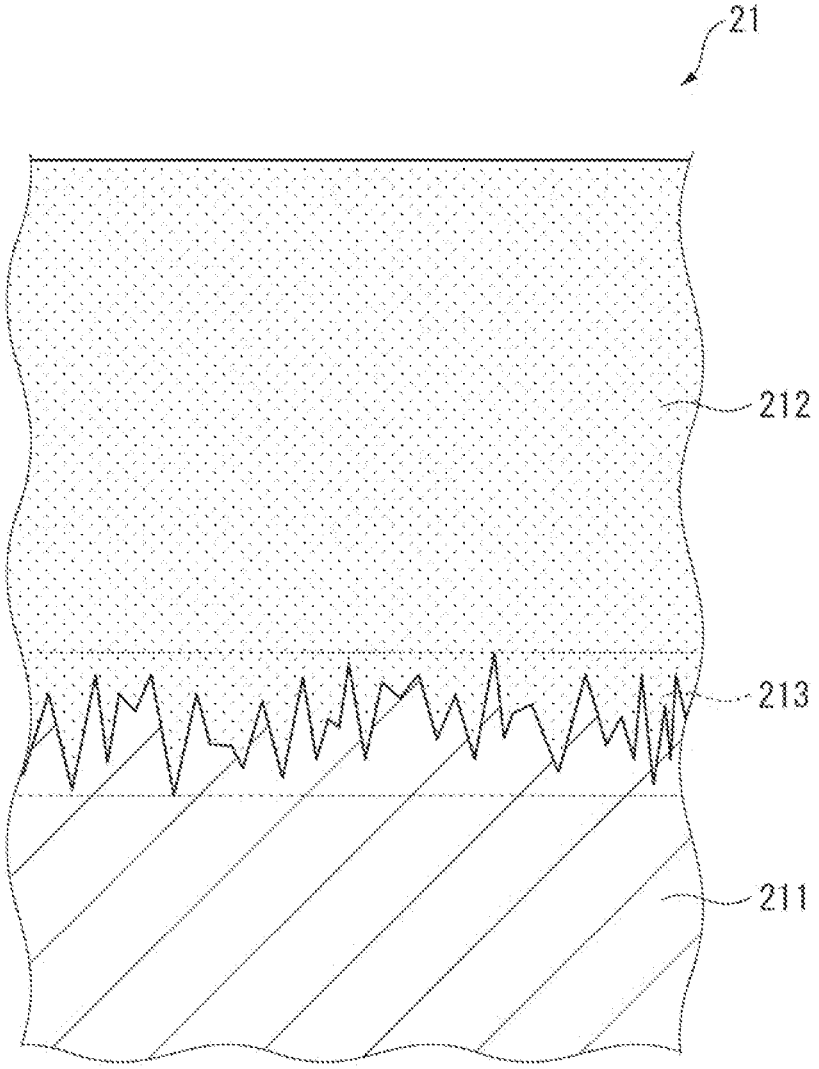
FIG. 2 is a cross-sectional view illustrating a main part of a case main body.

FIG. 2 is a cross-sectional view illustrating a main part of the case main body 21, specifically, a predetermined range from a surface of the case main body 21.

As illustrated in FIG. 2, the case main body 21 is formed of ferritic stainless steel including a base 211 formed of a ferrite phase, a surfacing layer 212 formed of an austenite phase (hereinafter, an austenitized phase) in which the ferrite phase is austenitized, and a mixed layer 213 in which the ferrite phase and the austenitized phase are mixed with each other.

Base

The base 211 contains, in percent by mass, Cr: 18 to 22%, Mo: 1.3 to 2.8%, Nb: 0.05 to 0.50%, Cu: 0.1 to 0.8%, Ni: less than 0.5%, Mn: less than 0.8%, Si: less than 0.5%, P:

less than 0.10%, S: less than 0.05%, N: less than 0.05%, and C: less than 0.05%, with a balance being formed of ferritic stainless steel formed of Fe and unavoidable impurities.

Cr is an element that increases a transfer rate of nitrogen to the ferrite phase, and a diffusion rate of nitrogen in the ferrite phase, in nitrogen absorption treatment. When Cr is less than 18%, the transfer rate and diffusion rate of nitrogen decrease. Furthermore, when Cr is less than 18%, corrosion resistance of the surfacing layer 212 deteriorates. On the other hand, when Cr exceeds 22%, hardening occurs, and workability as a material worsens. Furthermore, when Cr exceeds 22%, an aesthetic appearance is spoiled. Thus, Cr content may be 18 to 22%, may be 20 to 22%, and may be 19.5 to 20.5%.

Mo is an element that increases the transfer rate of nitrogen to the ferrite phase, and the diffusion rate of nitrogen in the ferrite phase, in the nitrogen absorption treatment. When Mo is less than 1.3%, the transfer rate and diffusion rate of nitrogen decrease. Furthermore, when Mo is less than 1.3%, corrosion resistance as a material deteriorates. On the other hand, when Mo exceeds 2.8%, hardening occurs, and the workability as the material worsens. Furthermore, when Mo exceeds 2.8%, a configuration organization of the surfacing layer 212 becomes significantly heterogeneous, and the aesthetic appearance is spoiled. Thus, Mo content may be 1.3 to 2.8%, may be 1.8 to 2.8%, and may be 2.25 to 2.35%.

Nb is an element that increases the transfer rate of nitrogen to the ferrite phase, and the diffusion rate of nitrogen in the ferrite phase, in the nitrogen absorption treatment. When Nb is less than 0.05%, the transfer rate and diffusion rate of nitrogen decrease. On the other hand, when Nb exceeds 0.50%, hardening occurs, and the workability as the material worsens. Furthermore, a deposition section is generated, and the aesthetic appearance is spoiled. Thus, Nb content may be 0.05 to 0.50%, may be 0.05 to 0.35%, and may be 0.15 to 0.25%.

Cu is an element that controls absorption of nitrogen in the ferrite phase in the nitrogen absorption treatment. When Cu is less than 0.1%, a variation in nitrogen content in the ferrite phase increases. On the other hand, when Cu exceeds 0.8%, the transfer rate of nitrogen to the ferrite phase decreases. Thus, the Cu content may be 0.1 to 0.8%, may be 0.1 to 0.2%, and may be 0.1 to 0.15%.

Ni is an element that inhibits the transfer of nitrogen to the ferrite phase, and the diffusion of nitrogen in the ferrite phase, in the nitrogen absorption treatment. When Ni is equal to or greater than 0.5%, the transfer rate and the diffusion rate of nitrogen decrease. Furthermore, it is possible that corrosion resistance worsens, and that it becomes difficult to prevent occurrence of a metal allergy and the like. Thus, Ni content may be less than 0.5%, may be less than 0.2%, and may be less than 0.1%.

Mn is an element that inhibits the transfer of nitrogen to the ferrite phase, and the diffusion of nitrogen in the ferrite phase, in the nitrogen absorption treatment. When Mn is equal to or greater than 0.8%, the transfer rate and the diffusion rate of nitrogen decrease. Thus, Mn content may be less than 0.8%, may be less than 0.5%, and may be less than 0.1%.

Si is an element that inhibits the transfer of nitrogen to the ferrite phase, and the diffusion of nitrogen in the ferrite phase, in the nitrogen absorption treatment. When Si is equal to or greater than 0.5%, the transfer rate and the diffusion rate of nitrogen decrease. Thus, Si content may be less than 0.5%, and may be less than 0.3%.

P is an element that inhibits the transfer of nitrogen to the ferrite phase, and the diffusion of nitrogen in the ferrite phase, in the nitrogen absorption treatment. When P is equal to or greater than 0.10%, the transfer rate and the diffusion rate of nitrogen decrease. Thus, P content may be less than 0.10%, and may be less than 0.03%.

S is an element that inhibits the transfer of nitrogen to the ferrite phase, and the diffusion of nitrogen in the ferrite phase, in the nitrogen absorption treatment. When S is equal to or greater than 0.05%, the transfer rate and the diffusion rate of nitrogen decrease. Thus, S content may be less than 0.05%, and may be less than 0.01%.

N is an element that inhibits the transfer of nitrogen to the ferrite phase, and the diffusion of nitrogen in the ferrite phase, in the nitrogen absorption treatment. When N is equal to or greater than 0.05%, the transfer rate and the diffusion rate of nitrogen decrease. Thus, N content may be less than 0.05%, and may be less than 0.01%.

C is an element that inhibits the transfer of nitrogen to the ferrite phase, and the diffusion of nitrogen in the ferrite phase, in the nitrogen absorption treatment. When C is equal to or greater than 0.05%, the transfer rate and the diffusion rate of nitrogen decrease. Thus, C content may be less than 0.05%, and may be less than 0.02%.

Note that, the base 211 is not limited to the configuration described above, and it is sufficient that the base 211 is formed of the ferrite phase.

Surfacing Layer

The surfacing layer 212 is provided by performing the nitrogen absorption treatment on the base material formed of ferritic stainless steel, to austenitize the ferrite phase. In the present exemplary embodiment, nitrogen content in the surfacing layer 212 is set to 1.0 to 1.6% in percent by mass. In other words, nitrogen is contained at high concentrations in the surfacing layer 212. Accordingly, anticorrosive performance in the surfacing layer 212 can be improved.

Mixed Layer

In a step of forming the surfacing layer 212, the mixed layer 213 is generated by a variation in transfer rate of nitrogen entering the base 211 formed of the ferrite phase. In other words, at a location where the transfer rate of nitrogen is high, nitrogen enters into a deep location of the ferrite phase and the location is austenitized, and at a location where the transfer rate of nitrogen is low, the ferrite phase is austenitized only up to a shallow location, thus the mixed layer 213 is formed in which the ferrite phase and the austenitized phase are mixed with each other with respect to a depth direction. Note that, the mixed layer 213 is a layer including a shallowest site to a deepest site of the austenitized phase when viewed in a cross-section, and is a layer thinner than the surfacing layer 212.

Method for Manufacturing Case Main Body

Next, a method for manufacturing the case main body 21 will be described.

FIGS. 3 to 7 are schematic diagrams each illustrating a manufacturing step of the case main body 21. Note that, in each of FIGS. 3 to 7, a cross section of the case main body 21 is illustrated. In addition, in FIGS. 5 to 7, a thickness of the surfacing layer 212 is exaggeratingly illustrated in order to make it easy to understand a layer configuration. Furthermore, in FIGS. 5 to 7, the mixed layer 213 formed between the base 211 and the surfacing layer 212 is omitted in order to make it easy to understand.

First Processing Step

Figure 3:
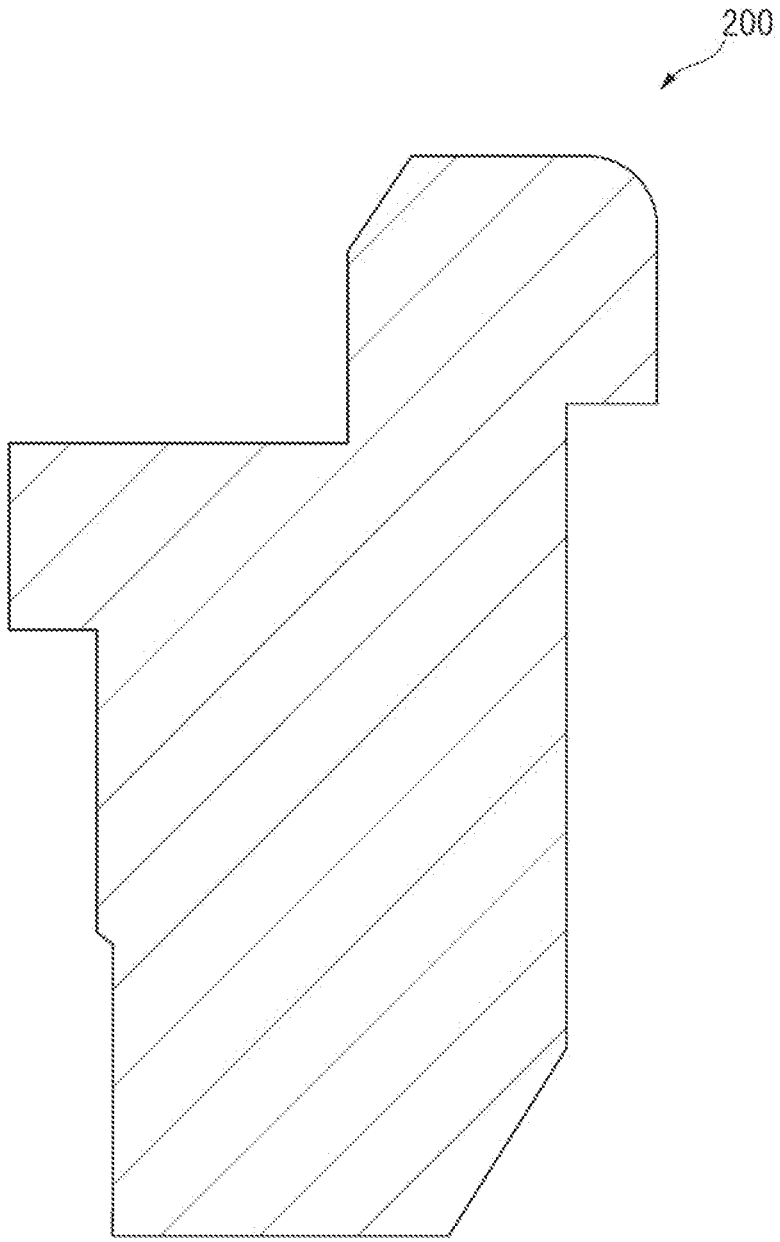
FIG. 3 is a schematic diagram illustrating a manufacturing step of the case main body.

First, as a first processing step, as illustrated in FIG. 3, a base material 200 formed of ferritic stainless steel is formed by performing processing such as cutting, forging, casting, powder molding, or the like, on ferritic stainless steel.

Figure 4:
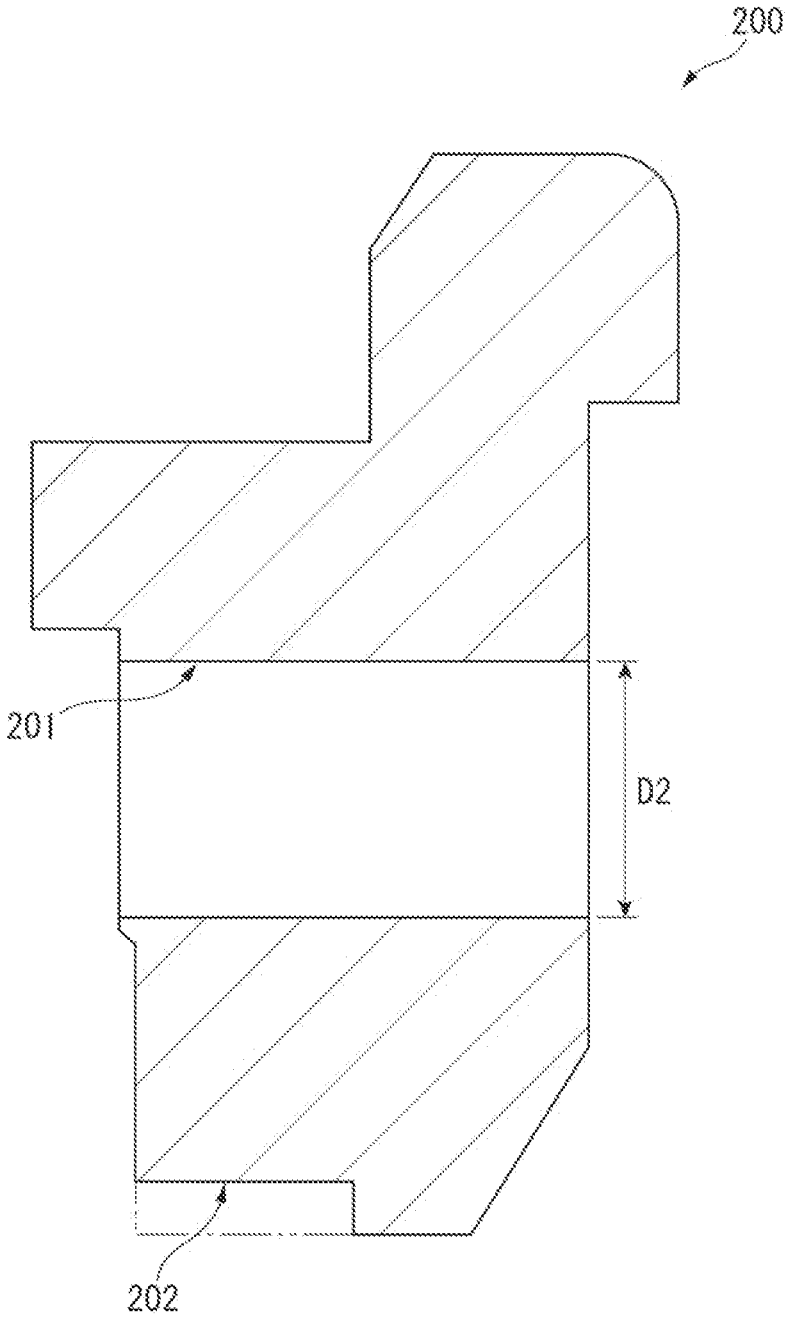
FIG. 4 is a schematic diagram illustrating a manufacturing step of the case main body.

Next, as illustrated in FIG. 4, a hole portion 201 is formed by cutting at a position corresponding to the through hole 21A of the base material 200. Note that, the hole portion 201 is formed such that a diameter D2 is smaller than the diameter D1 of the through hole 21A. In other words, the first processing step is a so-called rough processing step, and a cutting margin for cutting a location corresponding to the hole portion 201 in a second processing step described later is left.

Furthermore, a recessed portion 202 is formed by cutting at a position corresponding to the storage recessed portion 21C of the base material 200.

Heat Treatment Step

Figure 5:
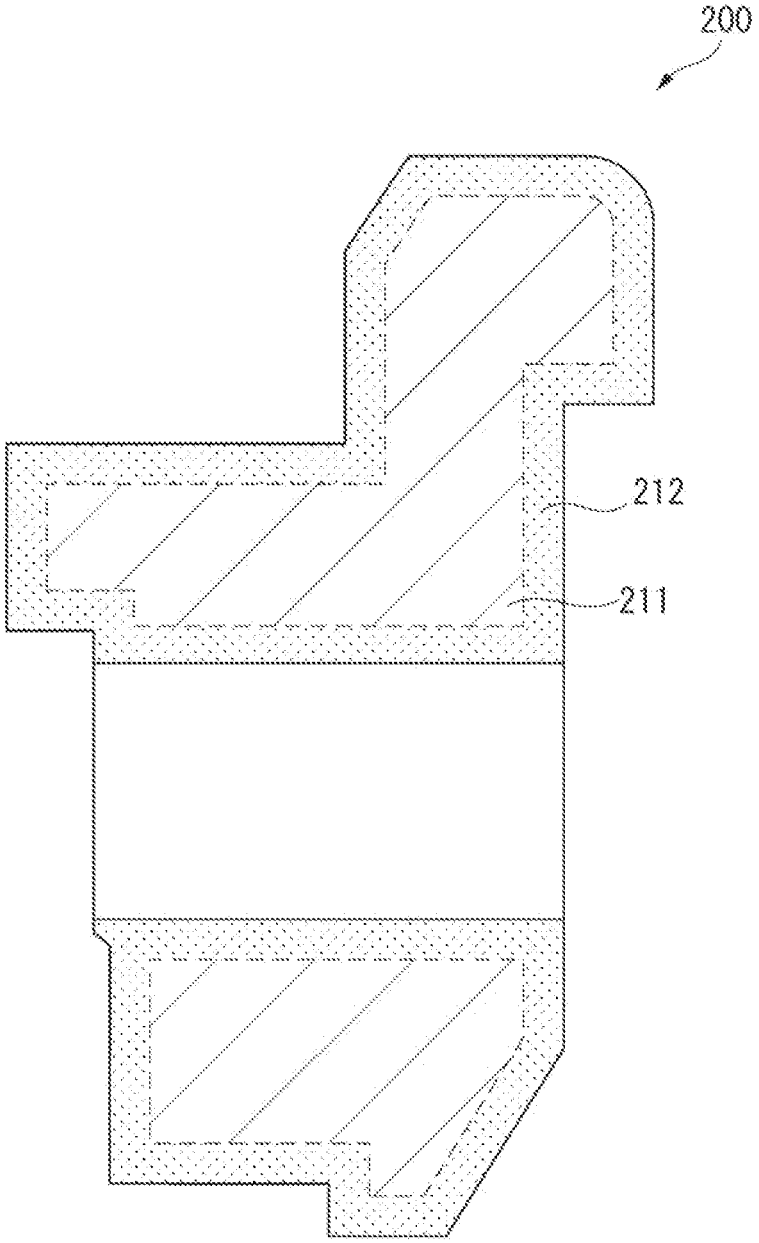
FIG. 5 is a schematic diagram illustrating a manufacturing step of the case main body.

Next, as a heat treatment step, as illustrated in FIG. 5, nitrogen absorption treatment is performed on the base material 200 processed as described above. In this step, nitrogen enters the base material 200 from a surface, and the surfacing layer 212 is formed in which the ferrite phase is austenitized, at a surface side of the base material 211. In other words, in the heat treatment step, the surfacing layer 212 is formed by nitrogen solid solution.

At this time, in the present exemplary embodiment, the nitrogen absorption treatment is performed on the base material 200 such that nitrogen content of the surfacing layer 212 is 1.0 to 1.6% in percent by mass. Furthermore, the nitrogen absorption treatment is performed on the base material 200 such that the thickness of the surfacing layer 212 is approximately 500 μm. In other words, in the present exemplary embodiment, a treatment time and a temperature for the nitrogen absorption treatment are controlled such that the base material 211 formed of the ferrite phase is left.

In this way, by performing the nitrogen absorption treatment on the base material 200, the base 211, the surfacing layer 212, and the mixed layer 213 are formed. That is, the base 211 is formed of the ferrite phase that remains after the nitrogen absorption treatment.

Second Processing Step

Figure 6:
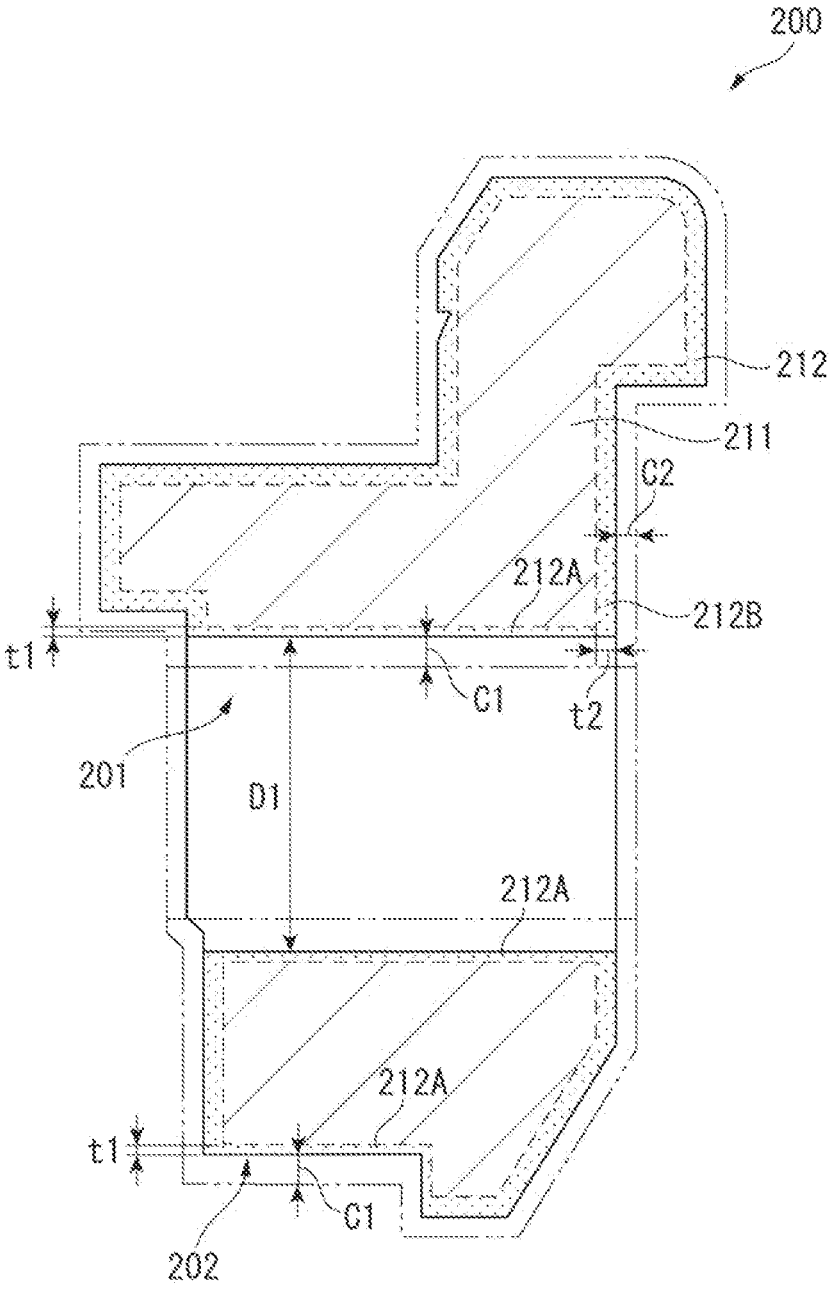
FIG. 6 is a schematic diagram illustrating a manufacturing step of the case main body.

Next, as a second processing step, as illustrated in FIG. 6, the surfacing layer 212 formed by the nitrogen absorption treatment is cut. In the present exemplary embodiment, throughout an entirety of the surface of the base material 200, the surfacing layer 212 is cut from the surface by a predetermined thickness. Accordingly, in the heat treatment step described above, for example, even when a deposition section such as chromium nitride is deposited on a surface of the surfacing layer 212, the deposition section can be removed, and a shape as the case main body 21 can be adjusted. In other words, the second processing step is a so-called main processing step for adjusting the shape of the case main body 21.

At this time, in the present exemplary embodiment, the surfacing layer 212 is cut such that a cut amount C1 of a surfacing layer 212A corresponding to the hole portion 201 and the recessed portion 202 is larger than a cut amount C2 of a surfacing layer 212B corresponding to a location other than the hole portion 201 and the recessed portion 202. Specifically, whereas the cut amount C1 of the surfacing layer 212A corresponding to the hole portion 201 and the recessed portion 202 is 100 μm to 150 μm, the cut amount C2 of the surfacing layer 212B corresponding to the location other than the hole portion 201 and the recessed portion 202 is 50 μm to 100 μm. In other words, in the present exemplary embodiment, whereas a thickness t1 of the surfacing layer 212A corresponding to the hole portion 201 and the recessed portion 202 is 350 μm to 400 μm, a thickness t2 of the surfacing layer 212B corresponding to the location other than the hole portion 201 and the recessed portion 202 is 400 μm to 450 μm.

Note that, at this time, after an entirety of the surfacing layer 212 is cut by a predetermined cut amount, the surfacing layer 212A corresponding to the hole portion 201 and the recessed portion 202 may be cut in addition. Alternatively, the cutting may be performed such that the surfacing layer 212A corresponding to the hole portion 201 and the recessed portion 202, and the surfacing layer 212B corresponding to the location other than the hole portion 201 and the recessed portion 202 are different in cut amount.

In addition, in FIG. 6, sizes of the respective cut amounts C1 and C2 of the surfacing layer 212 are exaggeratingly illustrated, to make it easy to understand.

Furthermore, in the present exemplary embodiment, the diameter of the hole portion 201 after the surfacing layer 212A is cut is D1. That is, in the second processing step, the surfacing layer 212A of the hole portion 201 is cut such that the diameter of the hole portion 201 is identical to the diameter D1 of the through hole 21A described above.

Here, in the present exemplary embodiment, as described above, in the first processing step, the hole portion 201 is formed such that the diameter D2 is smaller than the diameter D1 of the through hole 21A. Thus, by cutting, the diameter of the hole portion 201 can be changed from D2 to D1, thereby making it easy to form the through hole 21A with high dimensional accuracy, while ensuring hardness and corrosion resistance of the surface of the case main body.

Third Processing Step

Figure 7:
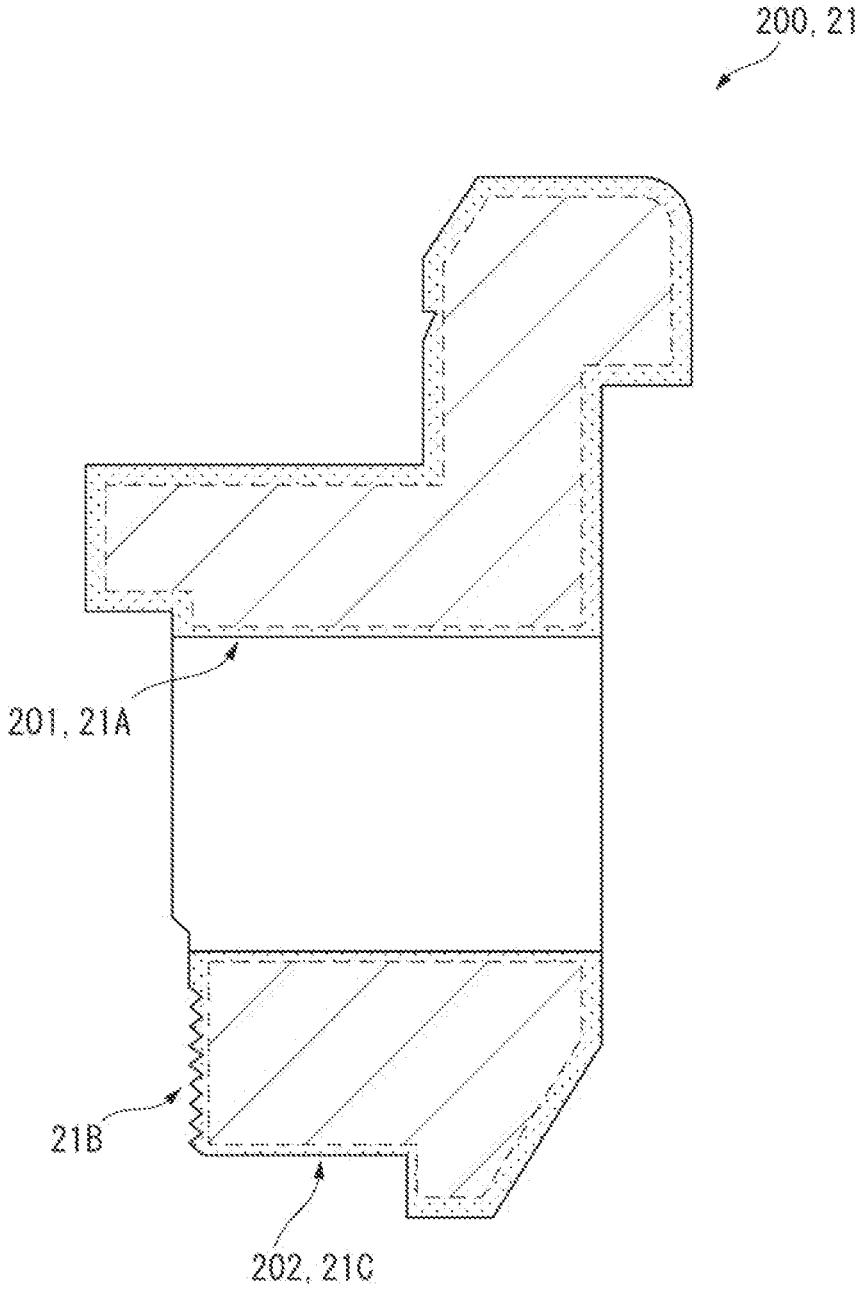
FIG. 7 is a schematic diagram illustrating a manufacturing step of the case main body.

Additionally, as a third processing step, as illustrated in FIG. 7, the surfacing layer 212 corresponding to the threaded portion 21B is subjected to threading to form the threaded portion 21B. At this time, in the threaded portion 21B, the surfacing layer 212 is cut such that the base 211 is not exposed.

Polishing Step

Finally, as a polishing step, the surface of the surfacing layer 212 is polished to form the case main body 21. In the present exemplary embodiment, in the polishing step, the surface of the surfacing layer 212 exposed to an external space of the case main body 21 is polished. Accordingly, the surface of the surfacing layer 212 can be smoothed, and thus, wear resistance and corrosion resistance can be improved, and design can be improved by improving the specularity of the surface.

Effect of Exemplary Embodiment

According to the present exemplary embodiment, the following advantageous effects can be produced.

The method for manufacturing the case main body 21 of the present exemplary embodiment includes the first processing step for forming the hole portion 201 and the recessed portion 202 in the base material 200 formed of ferritic stainless steel, the heat treatment step for performing the nitrogen absorption treatment on the base material 200 to form the surfacing layer 212, and the second processing step for cutting the surfacing layer 212A corresponding to the hole portion 201 and the recessed portion 202 to form the case main body 21.

Accordingly, the surfacing layer 212A formed of the austenitized phase can also be provided at a location corresponding to the hole portion 201 and the recessed portion 202, thus it is possible to prevent that the ferrite phase is exposed in the hole portion 201 and the recessed portion 202 and corrosion resistance is deteriorated.

Furthermore, in the present exemplary embodiment, after the heat treatment step, the second processing step is performed in which the surface of the surfacing layer 212 is cut, thus, even if the base material 200 is thermally deformed in the heat treatment step, the deformation can be rectified in the second processing step. Thus, compared to a case where a base material is machined and then heat treatment is performed to form a watch component such as a case main body, dimensional accuracy as a watch component can be increased.

Furthermore, in the present exemplary embodiment, only the surfacing layer 212 formed of the austenitized phase is cut in the second processing step. Thus, for example, cutting can be easily performed, compared to a case where a through hole is provided after a heat treatment step. Specifically, whereas in the case where the through hole is provided after the heat treatment step, both an austenitized phase and a ferrite phase need to be cut, and thus, cutting is required to be performed corresponding to phases different in characteristics, in the present exemplary embodiment, it is sufficient that cutting is performed only corresponding to the austenitized phase, thereby making it easier to perform the cutting.

In the present exemplary embodiment, in the second processing step, the surfacing layer 212 is processed to form the threaded portion 21B.

In this way, the surfacing layer 212 can be provided also in the threaded portion 21B that is subjected to threading. Thus, in the threaded portion 21B, it is possible to prevent that the ferrite phase is exposed and corrosion resistance is deteriorated.

In the present exemplary embodiment, in the heat treatment step, the surfacing layer 212 formed of the austenitized phase is formed by the nitrogen solid solution.

Accordingly, the corrosion resistance and the wear resistance in the surfacing layer 212 can be improved.

In the present exemplary embodiment, in the heat treatment step, throughout the entirety of the surface of the base material 200 that is subjected to the nitrogen absorption treatment, the surfacing layer 212 is cut from the surface by the predetermined thickness.

Accordingly, in the heat treatment step, for example, even when a deposition section such as chromium nitride is deposited on the surface of the surfacing layer 212, the deposition section can be removed, thus it is possible to prevent the corrosion resistance and the like from being deteriorated by the deposition section.

In the present exemplary embodiment, in the second processing step, the cutting is performed such that the cut amount C1 of the surfacing layer 212A corresponding to the hole portion 201 and the recessed portion 202 is larger than the cut amount C2 of the surfacing layer 212B corresponding to the location other than the hole portion 201 and the recessed portion 202.

Accordingly, a cutting margin of each of the hole portion 201 and the recessed portion 202 is increased, thus for example, even when the location corresponding to the hole portion 201 and the recessed portion 202 thermally deforms greatly in the heat treatment step, it is possible to make it easy to rectify the deformation. Thus, dimensional accuracy of the through hole 21A and the storage recessed portion 21C can be increased. In addition, since the thickness of the surfacing layer 212B corresponding to the location other than the hole portion 201 and the recessed portion 202 is large, even when the thickness of the surfacing layer decreases due to a polishing step or a stripe forming step in subsequent steps, or also re-polishing during overhaul, hardness and corrosion resistance required as a case can be maintained.

In the present exemplary embodiment, the base 211 contains, in percent by mass, Cr: 18 to 22%, Mo: 1.3 to 2.8%, Nb: 0.05 to 0.50%, Cu: 0.1 to 0.8%, Ni: less than 0.5%, Mn: less than 0.8%, Si: less than 0.5%, P: less than 0.10%, S: less than 0.05%, N: less than 0.05%, and C: less than 0.05%, with a balance being formed of Fe and unavoidable impurities.

This makes it possible to increase the transfer rate of nitrogen to the ferrite phase, and the diffusion rate of nitrogen in the ferrite phase, in the nitrogen absorption treatment.

In the present exemplary embodiment, in the heat treatment step, the nitrogen absorption treatment is performed on the base material 200 such that the nitrogen content of the surfacing layer 212 is 1.0 to 1.6% in percent by mass.

Accordingly, the corrosion resistance in the surfacing layer 212 can be improved.

In the present exemplary embodiment, after the second processing step, the polishing step is performed in which the surface of the case main body 21 is polished.

This makes it possible to improve the wear resistance and the corrosion resistance, and improve the design.

Modification Example

Note that the present disclosure is not limited to each of the exemplary embodiments described above, and variations, modifications, and the like within the scope in which the object of the present disclosure can be achieved are included in the present disclosure.

In the exemplary embodiment described above, the watch component of the present disclosure is configured as the case main body 21, but is not limited thereto. For example, the watch component of the present disclosure may be configured as any one of a piece of a band, an end-piece, a clasp, a bezel, a case back, a crown, a button, and an outer body. Additionally, the watch may have a plurality of the watch components as described above.

In the exemplary embodiment described above, after the second processing step, the third processing step for forming the threaded portion is performed, but the present disclosure is not limited thereto. For example, the present disclosure includes a case where the third processing step is not performed. In addition, in the exemplary embodiment described above, the polishing step is performed in which the surface of the surfacing layer 212 is polished, but the present disclosure is not limited thereto. For example, stripe forming processing may be performed in which stripes are provided on the surface of the surfacing layer. Furthermore, a decorating step such as plating processing on the surface may be added. By adopting the configuration as described above, the design can be further improved.

In the exemplary embodiment described above, the case main body 21 includes the base 211 formed of the ferrite phase, the surfacing layer 212 formed of the austenitized phase, and the mixed layer 213 in which the ferrite phase and the austenitized phase are mixed with each other, but the present disclosure is not limited thereto. For example, the case main body may be configured to include the surfacing layer 212, the mixed layer 213, the base 211, and additionally, a second mixed layer and a second surfacing layer provided on a side opposite to the mixed layer 213 and the surfacing layer 212 with respect to the base 211. That is, a configuration may be adopted in which the first mixed layer and the first surfacing layer are included on an outer peripheral side of the case main body, the second mixed layer and the second surfacing layer are included on an inner circumferential side, and the base is included between the first mixed layer and the second mixed layer.

In the exemplary embodiment described above, the method for manufacturing the case main body 21, which is the watch component, is illustrated, but the present disclosure is not limited thereto. For example, the method for manufacturing of the present disclosure may be applied to a case of an electronic device other than a watch, that is, for an electronic device component such as a housing.

Summary of Present Disclosure

A method for manufacturing a watch component of the present disclosure is a method for manufacturing a watch component formed of austenitized ferritic stainless steel including a base formed of a ferrite phase, and a surfacing layer formed of an austenitized phase in which the ferrite phase is austenitized, that includes a first processing step for forming a hole portion or a recessed portion at a base material formed of ferrite stainless steel, a heat treatment step for performing a nitrogen absorption treatment on the base material to form the surfacing layer at a surface side of the base, and a second processing step for cutting the surfacing layer corresponding to the hole portion or the recessed portion to form the watch component.

Accordingly, a surfacing layer formed of an austenitized phase can also be provided at a location corresponding to the hole portion or the recessed portion, thus it is possible to prevent that the ferrite phase is exposed in the hole portion or the recessed portion and corrosion resistance is deteriorated.

Furthermore, after the heat treatment step, the second processing step is performed in which the surface of the surfacing layer is cut, thus, even when the base material is thermally deformed in the heat treatment step, the deformation can be rectified in the second processing step. Thus, compared to a case where a base material is machined and then heat treatment is performed to form a watch component such as a case main body, dimensional accuracy as a watch component can be increased.

Furthermore, in the second processing step, only the surfacing layer formed of the austenitized phase is cut, thus, for example, compared to a case in which a through hole is provided after a heat treatment step, and the like, it is possible to make it easy to perform cutting.

In the method for manufacturing the watch component of the present disclosure, the third processing step may be included in which the surfacing layer is subjected to threading to form a threaded portion.

In this way, a surfacing layer can also be provided in the threaded portion that is subjected to threading. Thus, in the threaded portion, it is possible to prevent that the ferrite phase is exposed and corrosion resistance is deteriorated.

In the method for manufacturing the watch component of the present disclosure, in the heat treatment step, the surfacing layer may be formed by the nitrogen solid solution.

Accordingly, the corrosion resistance and the wear resistance in the surfacing layer can be improved.

In the method for manufacturing the watch component of the present disclosure, in the second processing step, throughout an entire surface of the base material that is subjected to the nitrogen absorption treatment, the surfacing layer may be cut by a predetermined thickness from the surface.

Accordingly, in the heat treatment step, for example, even when a deposition section such as chromium nitride is deposited on the surface of the surfacing layer, the deposition section can be removed, thus it is possible to prevent the hardness, the corrosion resistance, and the like from being deteriorated by the deposition section.

In the method for manufacturing the watch component of the present disclosure, in the second processing step, cutting may be performed such that a cut amount of a surfacing layer corresponding to the hole portion or the recessed portion is larger than a cut amount of a surfacing layer corresponding to a location other than the hole portion or the recessed portion.

Accordingly, a cutting margin of the hole portion or the recessed portion is increased, thus for example, even when the location corresponding to the hole portion or the recessed portion thermally deforms greatly in the heat treatment step, it is possible to make it easy to rectify the deformation.

In the method for manufacturing the watch component of the present disclosure, the base may contain, in percent by mass, Cr: 18 to 22%, Mo: 1.3 to 2.8%, Nb: 0.05 to 0.50%, Cu: 0.1 to 0.8%, Ni: less than 0.5%, Mn: less than 0.8%, Si: less than 0.5%, P: less than 0.10%, S: less than 0.05%, N: less than 0.05%, and C: less than 0.05%, with a balance being formed of Fe and unavoidable impurities.

This makes it possible to increase the transfer rate of nitrogen to the ferrite phase, and the diffusion rate of nitrogen in the ferrite phase, in the nitrogen absorption treatment.

In the method for manufacturing the watch component of the present disclosure, in the heat treatment step, the nitrogen absorption treatment may be performed on the base material such that the nitrogen content of the surfacing layer is 1.0 to 1.6% in percent by mass.

Accordingly, the corrosion resistance in the surfacing layer can be improved.

In the method for manufacturing the watch component of the present disclosure, in the first processing step, any one of forging, casting, and powder molding may be performed in addition to the cutting.

In the method for manufacturing the watch component of the present disclosure, the method may include the polishing step that is performed after the second processing step, and in which the surface of the watch component is polished.

This makes it possible to improve the wear resistance and the corrosion resistance, and improve the design.

In the method for manufacturing the watch component of the present disclosure, the watch component may be at least one of a case, a piece of a band, an end-piece, a clasp, a bezel, a case back, a crown, a button, and an outer body.

What is claimed is:

1. A method for manufacturing a watch component formed of austenitized ferritic stainless steel including a base formed of a ferrite phase and a surfacing layer formed of an austenitized phase in which the ferrite phase is austenitized, the method for manufacturing the watch component comprising:

a first processing step for forming a hole portion or a recessed portion at a base material formed of ferrite stainless steel;

a heat treatment step for performing a nitrogen absorption treatment on the base material to form the surfacing layer at a surface side of the base; and a second processing step for cutting the surfacing layer corresponding to the hole portion or the recessed portion to form the watch component.

2. The method for manufacturing the watch component according to claim 1, further comprising:

a third processing step for threading the surfacing layer to form a threaded portion.

3. The method for manufacturing the watch component according to claim 1, wherein in the heat treatment step, the surfacing layer is formed by a nitrogen solid solution.

4. The method for manufacturing the watch component according to claim 1, wherein in the second processing step, throughout an entire surface of the base material subjected to the nitrogen absorption treatment, the surfacing layer is cut by a predetermined thickness from the surface.

5. The method for manufacturing the watch component according to claim 1, wherein in the second processing step, cutting is performed such that a cut amount of a surfacing layer corresponding to the hole portion or the recessed portion is larger than a cut amount of a surfacing layer corresponding to a location other than the hole portion or the recessed portion.

6. The method for manufacturing the watch component according to claim 1, wherein the base contains, in percent by mass, Cr: 18 to 22%, Mo: 1.3 to 2.8%, Nb: 0.05 to 0.50%, Cu: 0.1 to 0.8%, Ni: less than 0.5%, Mn: less than 0.8%, Si: less than 0.5%, P: less than 0.10%, S: less than 0.05%, N: less than 0.05%, and C: less than 0.05%, with a balance being formed of Fe and unavoidable impurities.

7. The method for manufacturing the watch component according to claim 1, wherein in the heat treatment step, the nitrogen absorption treatment is performed on the base material such that a nitrogen content of the surfacing layer is 1.0 to 1.6% in percent by mass.

8. The method for manufacturing the watch component according to claim 1, wherein in the first processing step, any one of forging, casting, and powder molding is performed in addition to cutting.

9. The method for manufacturing the watch component according to claim 1, further comprising:

a polishing step, performed after the second processing step, for polishing a surface of the watch component.

10. The method for manufacturing the watch component according to claim 1, wherein the watch component is at least one of a case, a piece of a band, an end-piece, a clasp, a bezel, a case back, a crown, a button, and an outer body.

* * * * *